US009309762B2

(12) United States Patent
MacDonald et al.

(10) Patent No.: US 9,309,762 B2
(45) Date of Patent: Apr. 12, 2016

(54) CONTROLLED FULL FLOW PRESSURE PULSER FOR MEASUREMENT WHILE DRILLING (MWD) DEVICE

(75) Inventors: Robert MacDonald, Houston, TX (US); Gabor Vecseri, Houston, TX (US); Benjamin Jennings, Houston, TX (US)

(73) Assignee: Teledrill, Inc., Katy, TX (US)

( * ) Notice: Subject to any disclaimer, the term of this patent is extended or adjusted under 35 U.S.C. 154(b) by 716 days.

(21) Appl. No.: 13/368,997

(22) Filed: Aug. 21, 2012

(65) Prior Publication Data

US 2013/0048379 A1 Feb. 28, 2013

Related U.S. Application Data

(63) Continuation-in-part of application No. 13/336,981, filed on Dec. 23, 2011, now Pat. No. 9,133,664.

(60) Provisional application No. 61/529,329, filed on Aug. 31, 2011.

(51) Int. Cl.
*E21B 21/08* (2006.01)
*E21B 47/18* (2012.01)

(52) U.S. Cl.
CPC ..... *E21B 47/187* (2013.01)

(58) Field of Classification Search
CPC ..... E21B 21/08; E21B 47/18
See application file for complete search history.

(56) References Cited

U.S. PATENT DOCUMENTS 2,397,070 A 3/1946 Zublin
2,797,893 A 7/1957 McCune et al.
2,858,107 A 10/1958 Colmerauer
3,958,217 A 5/1976 Spinnler
4,436,165 A 3/1984 Emery
4,807,704 A 2/1989 Hsu et al.
4,901,290 A 2/1990 Feld et al.
5,009,272 A 4/1991 Walter
5,040,155 A 8/1991 Feld
5,190,114 A 3/1993 Walter
5,508,975 A 4/1996 Walter
5,626,016 A 5/1997 Walter
6,053,261 A 4/2000 Walter
6,082,473 A 7/2000 Dickey
6,102,138 A 8/2000 Fincher (Continued)

FOREIGN PATENT DOCUMENTS

EP 0681090 A2 11/1995
WO 2010071621 A1 6/2010

*Primary Examiner* — Catherine Loikith
(74) *Attorney, Agent, or Firm* — Guerry L. Grune; ePatentManager

(57) ABSTRACT

An apparatus, method, and system described for generating pressure pulses in drilling fluid utilizing a flow throttling device which includes a controllable pulser operating sequentially within a downhole assembly within a drill string of a drill pipe. The system includes drilling fluid, fluid flow, and fluid drilling pump which when combined creates fluid flow into a bore pipe annulus within the downhole assembly creating a base line bore pipe pressure wherein bore pipe pressure is sensed via a sensor and information is sent to a Digital Signal Processor (DSP) that interprets the information. The DSP also receives information from an annulus pressure sensor that senses drilling fluid pressure as it returns to the pump. The DSP recognizes pressure variation input from the annulus pressure sensor and bore pipe pressure sensor and detects pressure variation providing signals as data information to the DSP, determining required action to adjust pulser operation.

4 Claims, 5 Drawing Sheets

(56) References Cited

U.S. PATENT DOCUMENTS

| | | | |
|---|---|---|---|
| 6,237,701 | B1 | 5/2001 | Kolle et al. |
| 6,279,670 | B1 | 8/2001 | Eddison et al. |
| 6,338,390 | B1 | 1/2002 | Tibbetts |
| 6,439,316 | B1 | 8/2002 | Penisson |
| 6,508,317 | B2 | 1/2003 | Eddison et al. |
| 6,588,518 | B2 | 7/2003 | Eddison |
| 6,668,948 | B2 | 12/2003 | Buckman et al. |
| 6,840,337 | B2 | 1/2005 | Terry et al. |
| 6,997,272 | B2 | 2/2006 | Eppink |
| 7,011,156 | B2 | 3/2006 | von Gynz-Rekowski |
| 7,032,689 | B2 | 4/2006 | Goldman et al. |
| 7,051,821 | B2 | 5/2006 | Samuel |
| 7,100,708 | B2 | 9/2006 | Koederitz |
| 7,139,219 | B2 | 11/2006 | Kolle et al. |
| 7,180,826 | B2 | 2/2007 | Kusko |
| 7,958,952 | B2 | 6/2011 | Kusko et al. |
| 2003/0026167 | A1* | 2/2003 | Hahn et al. ..... 367/38 |
| 2006/0072374 | A1 | 4/2006 | Kusko |
| 2008/0179093 | A1 | 7/2008 | Kusko |
| 2008/0271923 | A1 | 11/2008 | Kusko |
| 2009/0107723 | A1 | 4/2009 | Kusko |
| 2009/0114396 | A1 | 5/2009 | Kusko |
| 2010/0147525 | A1 | 6/2010 | Lerner |

* cited by examiner

CONTROLLED FULL FLOW PRESSURE PULSER FOR MEASUREMENT WHILE DRILLING (MWD) DEVICE

PRIORITY STATEMENT

This patent application is a Continuation-In-Part and takes priority from U.S. Non-Provisional application Ser. No. 13/336,981 entitled "Controlled Pressure Pulser for Coiled Tubing Applications" filed on Dec. 23, 2011, which is a nonprovisional conversion of U.S. Provisional Application No. 61/529,329 entitled "Full Flow Pulser for Measurement While Drilling (MWD) Device filed on Aug. 31, 2011. The entire contents of both applications, as filed are hereby incorporated by reference.

Additionally U.S. Pat. No. 7,180,826 and US Application Number 2007/0104030A1 to Kusko, et. al., the contents of which are completely and hereby fully incorporated by reference.

FIELD OF DISCLOSURE

The current invention includes an apparatus and a method for creating a pulse within the drilling fluid, generally known as drilling mud, that is generated by selectively initiating flow driven bidirectional pulses within a bore pipe. Features of the device include operating a flow throttling device [FTD] that operates without a centrally located valve guide within a newly designed annular flow channel, such that the annular flow channel provides an increased area for the flow of the drilling fluid and also allows for the addition of an intelligent computerized control system using a combination of hardware and software tools with downlink capability. The downlink tools may be located above or below a positive displacement motor. The intelligent control system provides and maintains several parameters that effect drilling or other downhole activity efficiency (i.e. Weight on Bit, Rate of Penetration, Pulse Amplitude, Axial Vibration, Borehole Pressure, etc.) by utilizing a feedback control loop such that the pressure differentials within the collar and associated annulus of the FTD inside a bore pipe provide information for properly controlled, reproducible pressure pulses that exhibit little or no associated signal noise. The pulse received "up hole" from the tool down hole includes a series of dynamic pressure changes that provide pressure signals which can be used to interpret inclination, azimuth, gamma ray counts per second, etc. by oilfield personnel. These dynamic pressure changes and resulting signals are utilized to further increase yield in oilfield operations.

BACKGROUND

Current pulser technology utilizes pulsers that are sensitive to different fluid pump down hole pressures, and flow rates, and require field adjustments to pulse properly so that meaningful signals from these pulses can be received and interpreted uphole.

An important advantage of the present disclosure and the associated embodiments is that it decreases sensitivity to fluid flow rate or pressure within easily achievable limits, does not require field adjustment, and is capable of creating recognizable, repeatable, reproducible, yet controlled, clean [i.e. noise free] fluid pulse signals using minimum power due to a unique flow throttling device [FTD] with a pulser that requires no guide, guide pole or other guidance system to operate the main valve, thus reducing wear, clogging and capital investment of unnecessary equipment as well as increasing longevity and dependability in the down hole portion of the MWD tool. This MWD tool still utilizes battery, magneto-electric and/or turbine generated energy. The mostly unobstructed main flow in the main flow area enters with full flow into the cone without altering the main flow pattern. The increased flow rate and change in pressure produces a very efficient pilot valve response and associated energy pulses. Specifically, as the pilot valve closes faster (than in any known previous designs) this produces large pressure spike similar to a "water hammer" effect much like that is heard when shutting off a water faucet extremely quickly. The faster flow and corresponding larger pressure differential also moves the pilot valve into an open and closed position more rapidly. The faster the closure, the more pronounced the water hammer effect and the larger the pulse and associated measured spike associated with the pulse. These high energy pulses are also attributed to the position and integrity of the pilot channel seals (240) which ensure rapid and complete closure while maintaining complete stoppage of flow through the channel. The controllability of the pulser is also significantly enhanced in that the shape of the pressure wave generated by the energy pulse can be more precisely predetermined. The pulse rise and fall time is sharp and swift—much more so than with conventional devices utilizing guide pole designs. These more easily controlled and better defined energy pulses are easily distinguished from the background noise associated with MWD tools. Distinguishing from the "background" noise leading to ease of decoding signals occurring on an oil or gas rig offers tremendous advantages over current tools. By implementing the feedback control by utilizing sensors to detect pulse responses, the pulser can be programmed to operate intelligently responding based on measured sensor parameters using preprogrammed logic. Being able to control and determine pulse size, timing, and shape without ambiguity provides the user with reproducible, reliable data that results in reduced time on the rig for analysis and more reliable and efficient drilling.

U.S. Pat. No. 7,180,826 and US Application Number 2007/0104030A1 to Kusko, et. al., the contents of which are were completely fully incorporated by reference, disclose a fully functional pulser system that requires the use of a pulser guide pole to guide and define the movement of the main valve together with a different hydraulic channel designs than that of the present application and associated invention.

SUMMARY

The present disclosure involves the placement of a Measurement-While-Drilling (MWD) pulser device including a flow throttling device located within a bore pipe in a wellbore incorporating drilling fluids for directional and intelligent drilling. In the design, the pilot channel location is very different than in any prior application in that the channel is now located on the outside annulus. Features of the device include operating a flow throttling device [FTD] that operates without a centrally located valve guide within a newly designed annular flow channel, such that the annular flow channel provides an increased area for the flow of the drilling fluid and also allows for the addition of an intelligent computerized control system using a combination of hardware and software tools with downlink capability. The downlink tools may be located above or below a positive displacement motor. The intelligent control system provides and maintains several parameters that effect drilling or other downhole activity efficiency (i.e. Weight on Bit, Rate of Penetration, Pulse Amplitude, Axial Vibration, Borehole Pressure, etc.) by utilizing a feedback control loop such that the pressure differentials within the collar and associated annulus of the FTD inside a bore pipe provide information for properly guided, reproducible pressure pulses that exhibit little or no associated signal noise. The pulse received "up hole" from the tool down hole includes a series of dynamic pressure changes that provide pressure signals which can be used to interpret inclination, azimuth, gamma ray counts per second, etc. by oilfield personnel. These dynamic pressure changes and resulting signals are utilized to further increase yield in oilfield operations. The present invention also discloses a novel device for creating pulses in drilling fluid media flowing through a drill string. Past devices, currently in use, require springs or solenoids to assist in creating pulses and are primarily located in the main drilling fluid flow channel. U.S. Pat. No. 7,180,826 and US Application Number 2007/0104030A1 to Kusko, et. al., the contents of which are completely and hereby fully incorporated by reference, disclose a fully functional pulser system that requires the use of a pulser guide pole to guide and define the movement of the main valve together with a different hydraulic channel designs than that of the present application and associated invention. The pilot flow for the present invention without the guide pole allows for more efficient repair and maintenance processes and also allows for quickly replacing the newly designed apparatus of the present disclosure on the well site as there is at least a 15-20 percent reduction in capital costs and the costs on the maintenance side are drastically reduced. In the previous designs, guide pole failures accounted for 60-70 percent of the downhole problems associated with the older versions of the MWD. With the guide pole elimination, reliability and longer term down hole usage increases substantially, providing a more robust tool and much more desirable MWD experience.

Additionally, previous devices also required onsite adjustment of the flow throttling device (FTD) pulser according to the flow volume and fluid pressure and require higher energy consumption due to resistance of the fluid flow as it flows through an opened and throttled position in the drill collar.

The elimination of the centralized guide pole and pilot channel allows, in the current design, larger pressure differential to be created between the pilot flow and the main flow at the main valve thus increasing the control and calibration and operation of the pulser. The ability to precisely control the pulser and thus the pressure pulse signals is directly related to cleaner, more distinguishable and more defined signals that can be easier detected and decoded up hole.

Additional featured benefits of the present inventive device and associated methods include having a pulser tool above and/or below the PDM (positive displacement motor) allowing for intelligence gathering and transmitting of real time data by using the pulser above the motor and as an efficient drilling tool with data being stored in memory below the motor with monitored borehole pressure, acceleration, as well as downhole WOB control, among other drilling parameters. Drilling parameter control is accomplished by using a set point and threshold for the given parameter and adjusting based on effects provided by the shock wave generated using the FTD. Master control is provided uphole or downhole with a feedback loop from the surface of the well or from intelligent programming incorporated in the pulsing device in the BHA above and/or below the PDM The device provided by the current invention allows for the use of a flow throttling device that moves from an initial position to an intermediate and final position in both the upward and downward direction corresponding to the direction of the fluid flow. The present invention still avoids the use of springs, the use of which are described in the following patents which are also herewith incorporated by reference as presented in U.S. Pat. Nos. 3,958,217, 4,901,290, and 5,040,155.

DETAILED DESCRIPTION OF THE DRAWINGS

Figure 1:
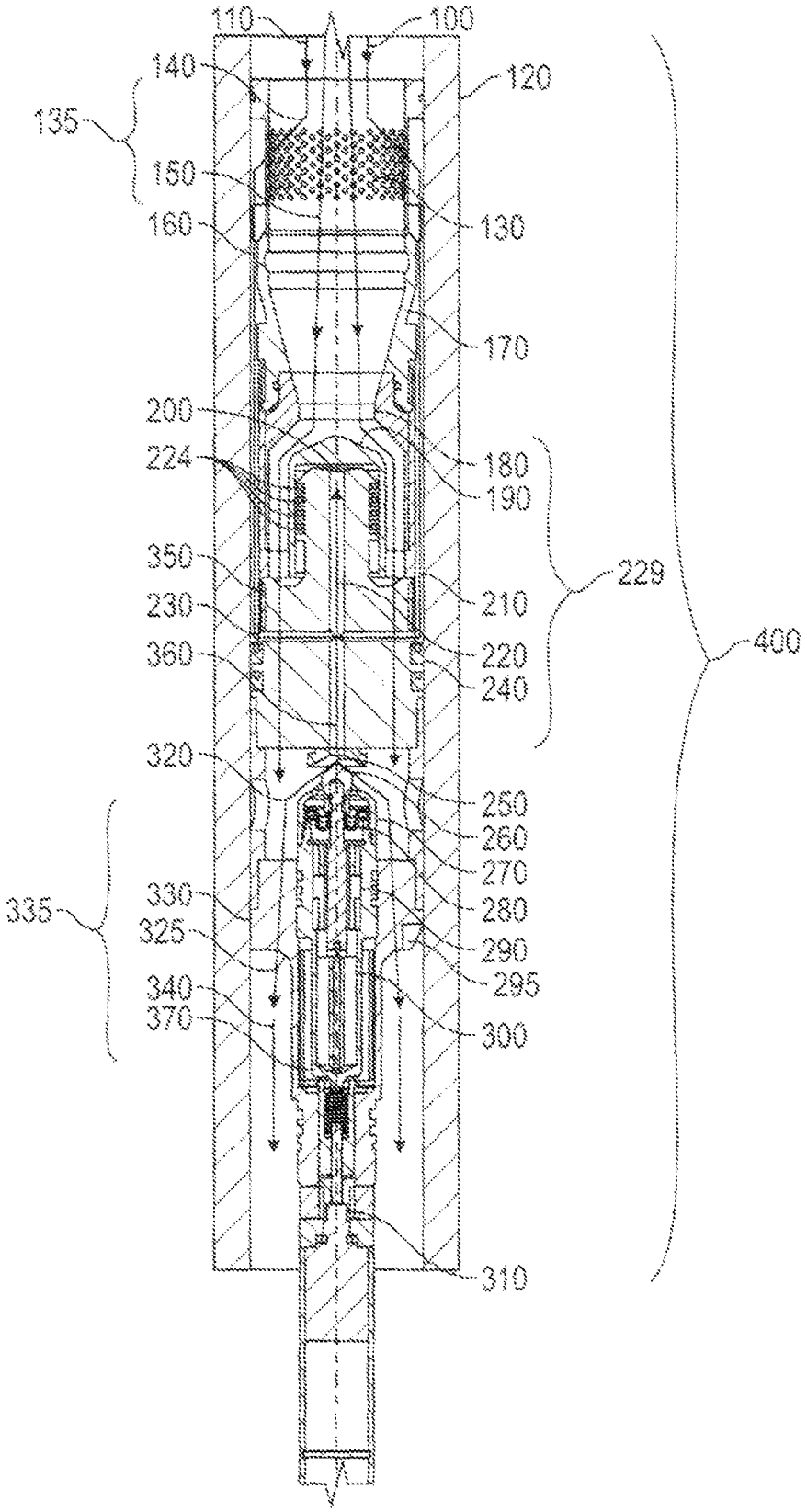
FIG. 1 is an overview of the full flow MWD with feedback control.

With reference now to FIG. 1, the pulser assembly [400] device illustrated produces pressure pulses in drilling fluid main flow [110] flowing through a tubular hang-off collar [120] and includes a pilot flow upper annulus [160]. The flow cone [170] is secured to the inner diameter of the hang off collar [120]. Major assemblies of the MWD are shown as provided including aligned within the bore hole the pilot flow screen assembly [135] and main valve actuator assembly [229] and pilot actuator assembly [335].

In FIG. 1, starting from an outside position and moving toward the center of the main valve actuator assembly [226] comprising a main valve [190], a main valve pressure chamber [200], a main valve support block [350], main valve seals [225] and flow guide seal [240]. The same figure shows the main valve feed channel [220], the pilot orifice [250], pilot valve [260], pilot flow shield [270], bellows [280] and the anti-rotation block [290], as well as a cylindrical support shoulder [325] and tool face alignment key [295] that exists below the pilot flow shield [270] for keeping the pulser assembly centered within the bore hole. This figure also shows the passage of the main flow [110] past the pilot flow screen [130] through the main flow entrance [150], into the flow cone [170], through the main orifice [180] into and around the main valve [190], past the main valve pressure chamber [200], past the main valve seals [225] through the main valve support block [350], after which it combines with the pilot exit flow [320] to become the main exit flow [340]. The pilot flow [100] flows through the pilot flow screen [130] into the pilot flow screen chamber [140], through the pilot flow upper annulus [160], through the pilot flow lower annulus [210] and into the pilot flow inlet channel [230], where it then flows up into the main valve feed channel [220] until it reaches the main valve pressure chamber [200] where it flows back down the main valve feed channel [220], through the pilot flow exit channel [360], through the pilot orifice [250], past the pilot valve [260] where the pilot exit flow [320] flows over the pilot flow shield [270] where it combines with the main flow [110] to become the main exit flow [340] as it exits the pilot valve support block [330] and flows on either side of the rotary magnetic coupling [300], past the drive shaft and the motor [310].

The pilot actuator assembly [335] includes a magnetic pressure cup [370], and encompasses the rotary magnetic coupling [300]. The magnetic pressure cup [370] and the rotary magnetic coupling [300] may comprise several magnets, or one or more components of magnetic or ceramic material exhibiting several magnetic poles within a single component. The magnets are located and positioned in such a manner that the rotary movement or the magnetic pressure cup [370] linearly and axially moves the pilot valve [260]. The rotary magnetic coupling [300] is actuated by the adjacent drive shaft [305].

Figure 2:
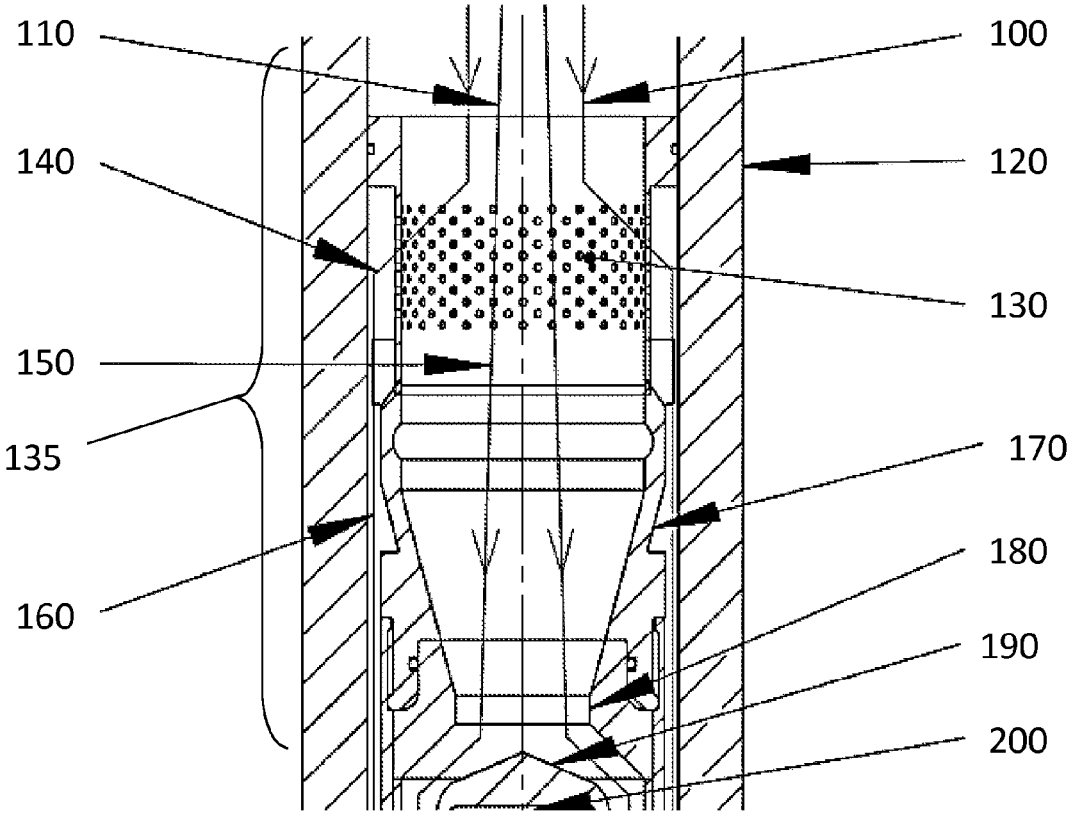
FIG. 2 is a close up of the pilot flow screen assembly

FIG. 2 provides details of the pulser assembly in the open position; the pilot flow [100] and main flow [110] both flow through the pilot flow screen assembly [135] and pilot flow screen [130] where a portion of the main flow [110] flows through the pilot flow screen [130]. The pilot flow [100] flows through the pilot flow screen chamber [140] and into the pilot flow upper annulus [160]. Pilot flow [100] and main flow [110] within the pilot flow screen assembly [135] flows through the main flow entrance [150] and through the flow cone [170] and into the main orifice [180] to allow for flow within the main valve feed channel [220].

Figure 3:
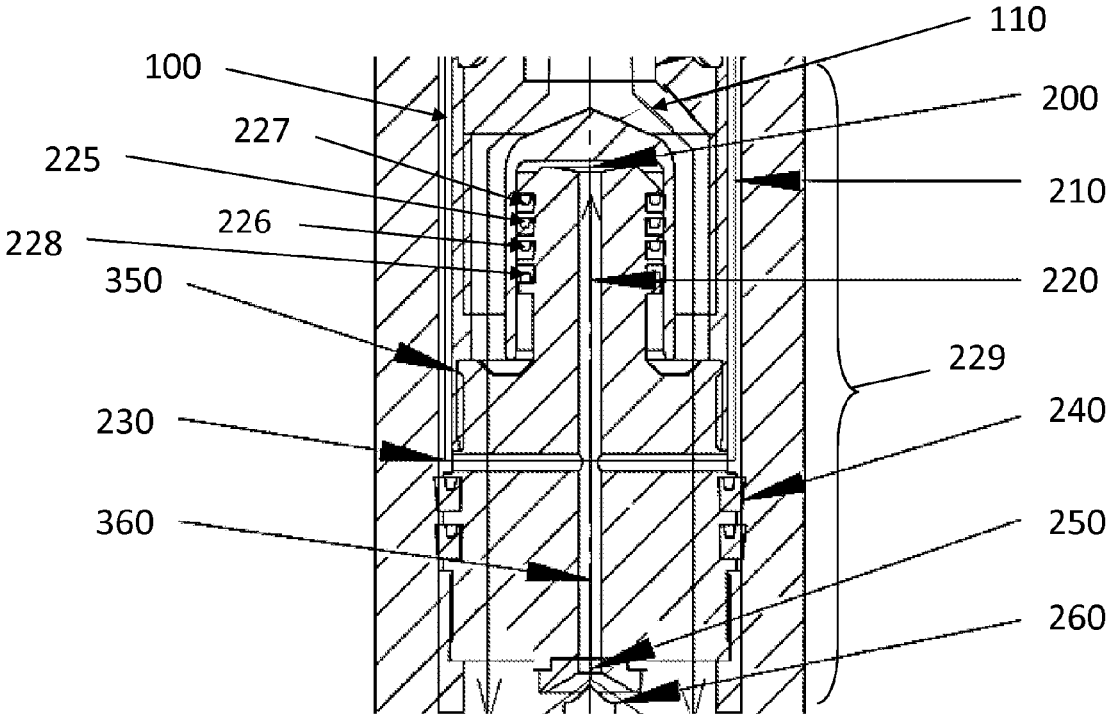
FIG. 3 is a detailed cross section of the main valve actuator assembly including the seals.

FIG. 3 describes the main valve actuator assembly [229] and illustrates the flow of the pilot flow [100] and main flow [110] areas with the main valve [190] in open position. The main flow [110] passes through openings in the main valve support block [350] while the pilot flow [100] flows through the pilot flow lower annulus [210], into the pilot flow inlet channel [230] and into the main valve feed channel [220] which puts pressure on the main valve pressure chamber [200]] when the pilot valve [260] is in closed position. The pilot flow [100] then flows out through the pilot flow exit channel [360], through the pilot orifice [250] and over the pilot valve [260]. Also shown are the seals [225, 226, 227, 228 &240] of the main valve actuator assembly.

When pilot valve [260] closes, pressure increases through the main valve feed channel [220] into the main valve pressure chamber [200]. The upper outer seal [227], upper inner seal [225], lower inner seal [226], lower outer seal [228] and flow guide seal [240] keep the pilot flow [100] pressure constrained and equal to the pressure that exists in main flow entrance [150] area. Upper outer seal [227] and lower outer seal [228] exclude large particulates from entering into the space where the upper inner seal [225] and lower inner seal [226] reside. The upper outer seal [227] and lower outer seal [228] do not support a pressure load and allow a small amount of pilot flow [100] to bypass while excluding particulates from entering the area around the upper inner seal [225] and lower inner seal [226]. This eliminates pressure locking between the inner seals [225, 226] and the outer seals [227, 228]. By excluding the particulates from entering into the space where the inner seals reside [225, 226] the seals are protected and the clearances of the inner seals [225, 226] can be reduced to support high pressure loads. Very small particulates can bypass the outer seals [227, 228], but the particulates must be very small in relative to the clearances of the inner seals [225, 226] to penetrate the space between the outer seals [227, 228] and inner seals [225, 226].

Figure 4:
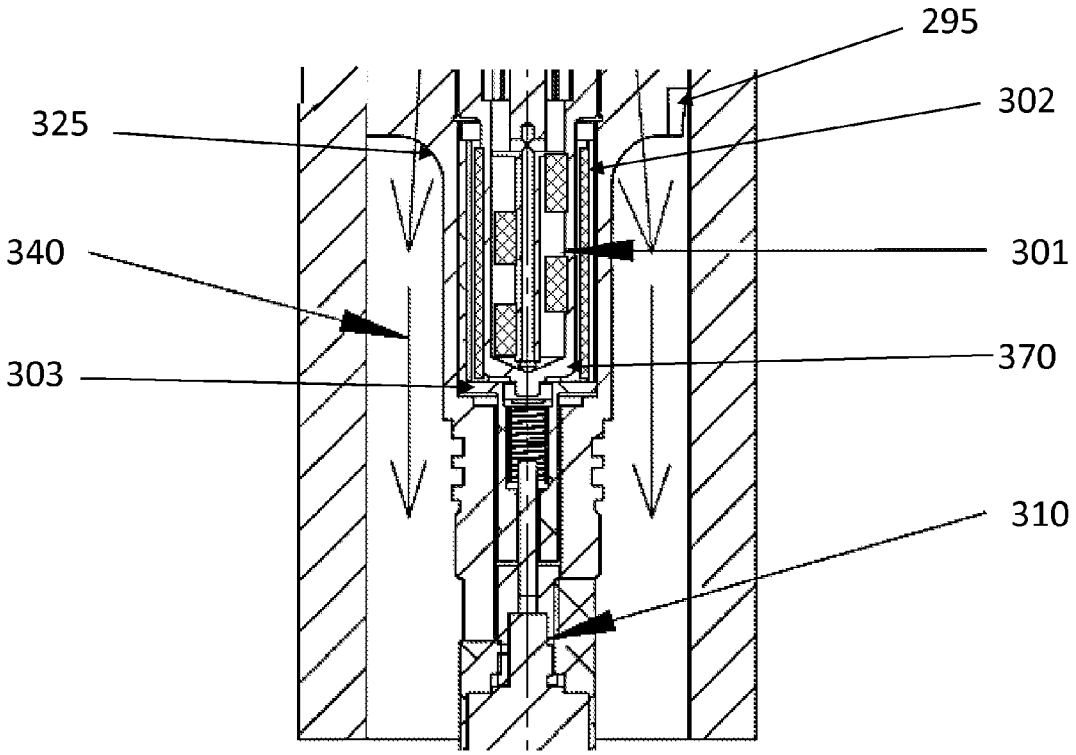
FIG. 4 shows the lower portion of the pilot actuator assembly, drive shaft and motor.

Referring to FIG. 4, an embodiment of the rotary magnetic coupling [300] and motor [310] is shown. The Main exit flow [340] flows parallel along each side of the rotary magnetic coupling [300] which is contained within the magnetic pressure cup [370], past the drive shaft and parallel along each side of the motor [310] down toward the cylindrical support shoulder [325] that includes a tool face alignment key [295] below the pilot flow shield [270]. The magnetic pressure cup [370] is comprised of a non-magnetic material, and is encompassed by the outer magnets [302]. The outer magnets [302] may comprise several magnets, or one or more components of magnetic or ceramic material exhibiting several magnetic poles within a single component. The outer magnets [302] are housed in an outer magnet housing [303] that is attached to the drive shaft. Within the magnetic pressure cup [370] are housed the inner magnets [301] which are permanently connected to the pilot valve [260].

The outer magnets [302] and the inner magnets [301] are placed so that the magnetic polar regions interact, attracting and repelling as the outer magnets [302] are moved about the inner magnets [301] The relational combination of magnetic poles of the moving outer magnets [302] and inner magnets [301], causes the inner magnets [301] to move the pilot valve [260] linearly and interactively without rotating. The use of outer magnets [302] and inner magnets [301] to provide movement from rotational motion to linear motion also allows the motor [310] to be located in an air atmospheric environment in lieu of a lubricating fluid environment. This also allows for a decrease in the cost of the motor [310], decreased energy consumption and subsequently decreased cost of the actual MWD device. It also alleviates the possibility of flooding the sensor area of the tool with the drilling fluid like in the use of a moving mechanical seal.

Figure 5:
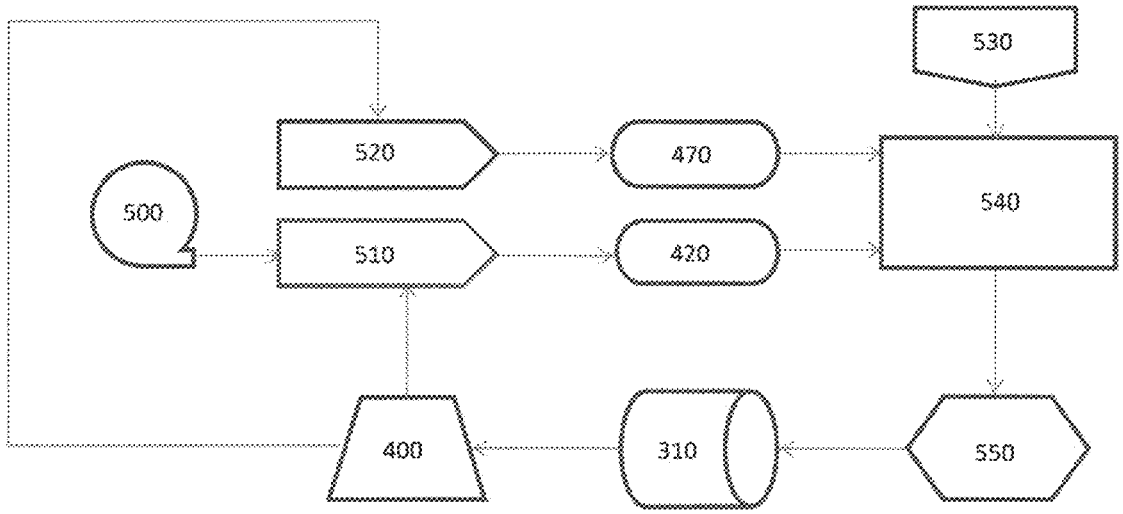
FIG. 5 is a pulser feedback control flow diagram.

The information flow on the Pulser Control Flow Diagram in FIG. 5 details the controllable pulser operation sequence. The drilling fluid pump, known as the mud pump [500] is creating the flow with a certain base line pressure. That fluid pressure is contained in the entirety of the interior of the drill string [510], known as the bore pressure. The bore pipe pressure sensor [420] is sensing this pressure increase when the pumps turn on, and send that information to the Digital Signal Processor (DSP) [540] which interprets it. The DSP [540] also receives information from the annulus pressure sensor [470] which senses the drilling fluid (mud) pressure as it returns to the pump [500] in the annular (outside) of the drill pipe [520]. Based on the pre-programmed logic [530] in the software of the DSP [540], and on the input of the two pressure sensors [420, 470] the DSP [540] determines the correct pulser operation settings and sends that information to the pulser motor controller [550]. The pulser motor controller [550] adjusts the stepper motor [310] current draw, response time, acceleration, duration, revolution, etc. to correspond to the pre-programmed pulser settings [530] from the DSP [540]. The stepper motor [310] driven by the pulser motor controller [550] operates the pilot actuator assembly [335] from FIG. 1. The pilot actuator assembly [335], responding exactly to the pulser motor controller [550], opens and closes the main valve [190], from FIG. 1, in the very sequence as dictated by the DSP [540]. The main valve [190] opening and closing creates pressure variations of the fluid pressure in the drill string on top of the bore pressure [510] which is created by the mud pump [500]. The main valve [190] opening and closing also creates pressure variations of the fluid pressure in the annulus of the drill string on top of the base line annulus pressure [520] because the fluid movement restricted by the main valve [190] affects the fluid pressure downstream of the pulser assembly [400] through the drill it jets into the annulus of the bore hole. Both the annulus pressure sensor [470] and the bore pipe pressure sensor [420] detecting the pressure variation due to the pulsing and the pump base line pressure sends that information to the DSP [540] which determines the necessary action to be taken to adjust the pulser operation based on the pre-programmed logic.

Operation—Operational Pilot Flow—all when the Pilot is in the Closed Position;

The motor [310] rotates the rotary magnetic coupling [300] which transfers the rotary motion to linear motion of the pilot valve [260] by using an anti-rotation block [290]. The mechanism of the rotary magnetic coupling [300] is immersed in oil and is protected from the drilling fluid flow by a bellows [280] and a pilot flow shield [270]. When the motor [310] moves the pilot valve [260] forward [upward in FIG. 1] into the pilot orifice [250], the pilot fluid flow is blocked and backs up as the pilot fluid in the pilot flow exit channel [360], pilot flow inlet channel [230] and in the pilot flow upper annulus [160] all the way back to the pilot flow screen [130] which is located in the lower velocity flow area due to the larger flow area of the main flow [110] and pilot flow [100] where the pilot flow fluid pressure is higher than the fluid flow through the main orifice [180]. The pilot fluid flow [100] in the pilot flow exit channel [360] also backs up through the main valve feed channel [220] and into the main valve pressure chamber [200]. The fluid pressure in the main valve pressure chamber [200] is equal to the main flow [110] pressure, but this pressure is higher relative to the pressure of the main fluid flow in the main orifice [180] in front portion of the main valve [190]. This differential pressure between the pilot flow flow in the main valve pressure chamber (200) area and the main flow through the main orifice [180] into the main orifice (180) causes the main valve [190] to act like a piston and to move toward closure [still upward in FIG. 1] causing the main orifice [180] to stop the flow of the main fluid flow [110] causing the main valve [190] to stop the main fluid flow [110] through the main orifice [180]. As the drilling fluid main flow [110] stops at the main valve [190] its pressure increases. Since the pilot flow lower annular [210] extends to the bore pipe pressure inlet [410] located in the pilot valve support block [330] the pressure change in the pilot fluid flow reaches the bore pipe pressure sensor [420] which transmits that information through the electrical connector [440] to the pulser control electronics DSP [450]. The pulser controlling electronics DSP [450] together with pressure data from the annulus pressure sensor [470] adjusts the pilot valve operation based on pre-programmed logic to achieve the desired pulse characteristics.

Opening Operation

When the motor (310) moves the pilot valve [260] away [downward in FIG. 1] from the pilot orifice [250] allowing the fluid to exit the pilot exit flow [320] and pass from the pilot flow exit channel [360] relieving the higher pressure in the main valve pressure chamber [200] this causes the fluid pressure to be reduced and the fluid flow to escape. In this instance, the main fluid flow [110] is forced to flow through the main orifice [180] to push open [downward in FIG. 1] the main valve [190], thus allowing the main fluid [110] to bypass the main valve [190] and to flow unencumbered through the remainder of the tool.

Pilot Valve in the Open Position

As the main flow [110] and the pilot flow [100] enter the main flow entrance [150] and combined flow through into the flow cone area [170], by geometry [decreased cross-sectional area], the velocity of the fluid flow increases. When the fluid reaches the main orifice [180] the fluid flow velocity is increased [reducing the pressure and increasing the velocity] and the pressure of the fluid is decreased relative to the entrance flows [main area vs. the orifice area] [180]. When the pilot valve [260] is in the opened position, the main valve [190] is also in the opened position and allows the fluid to pass through the main orifice [180] and around the main valve [190], through the openings in the main valve support block [350] through the pilot valve support block [330] and subsequently into the main exit flow [340].

The information flow on the Pulser Control Flow Diagram in FIG. 5 details the controllable pulser operation sequence. The drilling fluid pump, known as the mud pump [500] is creating the flow with a certain base line pressure. That fluid pressure is contained in the entirety of the interior of the drill string [510], known as the bore pressure. The bore pipe pressure sensor [420] is sensing this pressure increase when the pumps turn on, and sends that information to the Digital Signal Processor (DSP) [540] which interprets it. The DSP [540] also receives information from the annulus pressure sensor [470] which senses the drilling fluid (mud) pressure as it returns to the pump [500] in the annular (outside) of the drill pipe [520]. Based on the pre-programmed logic [530] in the software of the DSP [540], and on the input of the two pressure sensors [420, 470] the DSP [540] determines the correct pulser operation settings and sends that information to the pulser motor controller [550]. The pulser motor controller [550] adjusts the stepper motor [310] current draw, response time, acceleration, duration, revolution, etc. to correspond to the pre-programmed pulser settings [530] from the DSP [540]. The stepper motor [310] driven by the pulser motor controller [550] operates the pilot actuator assembly [335] as shown in FIG. 1. The pilot actuator assembly [335], responds directly to the pulser motor controller [550], and opens and closes the main valve [190], again shown in FIG. 1, in the sequence dictated by the DSP [540]. The main valve [190] opening and closing creates pressure variations of the fluid pressure in the drill string in addition to the bore pressure [510] which is created by the mud pump [500]. The main valve [190] opening and closing also creates pressure variations or fluctuations of the fluid pressure in the annulus of the drill string in addition to the base line annulus pressure [520] because the fluid movement restricted by the main valve [190] affects the fluid pressure downstream of the pulser assembly [400] through the drill as the fluid jets into the annulus of the bore hole. Both the annulus pressure sensor [470] and the bore pipe pressure sensor [420] detect the pressure variations exhibited by the pulsing pressures and the pump base line pressure. These variations provide signals that are sent as data information to the DSP [540] that determines the necessary action to be taken to adjust the pulser operation based on any pre-programmed logic provided.

DETAILED DESCRIPTION

The present invention will now be described in greater detail and with reference to the accompanying drawings. With reference now to FIG. 1, the device illustrated produces pressure pulses for pulsing of the pulser within a main valve actuator assembly of the flow throttling device (FTD) in the vertical upward and downward direction using drilling fluid that flows through a tubular rental collar and an upper annulus which houses the pilot flow. There is a flow cone secured to the inner diameter of a hang off collar with major assemblies of the MWD that include a pilot flow screen assembly, a main valve actuator assembly, and a pilot actuator assembly.

To enable the pulser to move in a pulsing upward and downward direction, the passage of the main flow of the drilling fluid flows through the pilot flow screen into the main flow entrance then into the flow cone section and through the main orifice and main valve past the main valve pressure chamber, past the seals, and finally into and through the main valve support block with the flow seal guide.

At this point, the initial drilling fluid combines with the pilot exit fluid and together results in the exit flow of the main fluid. The pilot fluid flow continues flowing through the pilot flow screen and into the pilot flow screen chamber then through the pilot flow upper annulus section, the pilot flow lower annulus section and into the pilot flow inlet channel where the fluid flows upward into the main valve feed channel until it reaches the main valve pressure chamber causing upward motion of the pulser. There, the fluid flows back down the main valve feed channel through the pilot flow exit channel and through the pilot orifice and pilot valve at which point the fluid exits the pilot area where it flows over the pilot flow shield and combines with the main flow to comprise the main exit flow as it exits the pilot valve support block and flows down both sides of the rotary magnetic coupling, outside the magnetic pressure cup and eventually past the drive shaft and the motor.

In operation to accomplish the task of providing for the pilot to attain the closed position, the motor rotates the rotary magnetic coupling transfers rotary motion to linear motion of the pilot valve by using an anti-rotation block. The mechanism of the rotary magnetic coupling is protected from the fluid flow by the use of a bellows and a pilot flow shield. When the motor moves the pilot valve forward—upward into the pilot orifice—the pilot valve blocks and backs up the pilot fluid in the pilot flow exit channel, the pilot flow inlet channel, and in the pilot flow upper annulus, such that the fluid back up and reaches all the way back to the pilot flow screen (which is located in the lower velocity flow area due to the geometry of the larger flow area of the main flow and pilot flow sections such that the pilot flow fluid pressure is higher than the fluid flow through the main orifice).

The pilot fluid flow in the pilot flow exit channel also backs up through the main valve feed channel and into the main valve pressure chamber. The fluid pressure in the main valve pressure chamber is now equal to the main flow pressure but the fluid pressure is higher relative to the pressure of the main fluid flow in the main orifice in the front portion of the main valve. The differential pressure between the pilot flow and the main flow through the main orifice causes the main valve to act like a piston and moves toward closure of the main orifice (upward direction in the Figures provided), thereby causing the main valve to provide a stoppage of the flow of the main fluid flow within the main orifice.

In another embodiment, the MWD device utilizes a turbine residing near and within the proximity of a flow diverter. The flow diverter diverts drilling mud in an annular flow channel into and away from the turbine blades such that the force of the drilling mud causes the turbine blades and turbine to rotationally spin around an induction coil. The induction coil generates electrical power for operating the motor and other instrumentation mentioned previously. The motor is connected to the pilot actuator assembly via a drive shaft. The pilot actuator assembly comprises a magnetic coupling and pilot assembly. The magnetic coupling comprises outer magnets placed in direct relation to inner magnets located within the magnetic pressure cup or magnetic coupling bulkhead. The magnetic coupling translates the rotational motion of the motor, via the outer magnets to linear motion of the inner magnets via magnetic polar interaction. The linear motion of the inner magnets moves the pilot assembly, comprising the pilot shaft, and pilot valve, linearly moving the pilot into the pilot seat. This action allows for closing the pilot seat, pressurizing the flow throttling device, closing the flow throttling device orifice, thereby generating a pressure pulse. Further rotation of the motor, drive shaft, via the magnetic coupling, moves the pilot assembly and pilot away from the pilot seat, depressurizing the flow throttling device sliding pressure chamber and opening the flow throttling device and completing the pressure pulse. Identical operation of the pilot into and out of the pilot seat orifice can also be accomplished via linear to linear and also rotation to rotation motions of the outer magnets in relation to the inner magnets such that, for example, rotating the outer magnet to rotate the inner magnet to rotate a (rotating) pilot valve causing changes in the pilot pressure, thereby pushing the FTD (flow throttling device) up or down.

Unique features of the pulser include the combination of middle and lower inner flow channels, flow throttling device, bellows, and upper and lower flow connecting channels possessing angled outlet openings that helps create signals transitioning from both the sealed [closed] and unsealed (open) positions. Additional unique features include a flow cone for transitional flow and a sliding pressure chamber designed to allow for generation of the pressure pulses. The flow throttling device slides axially on a pulser guide pole being pushed by the pressure generated in the sliding pressure chamber when the pilot is in the seated position. Additional data (and increased bit rate) is generated by allowing the fluid to quickly back flow through the unique connecting channel openings when the pilot is in the open position. Bi-directional axial movement of the poppet assembly is generated by rotating the motor causing magnets to convert the rotational motion to linear motion which opens and closes the pilot valve. The signal generated provides higher data rate in comparison with conventional pulsers because of the bidirectional pulse feature. Cleaner signals are transmitted because the pulse is developed in near-laminar flow within the uniquely designed flow channels and a water hammer effect due to the small amount of time required to close the flow throttling device.

The method for generating pressure pulses in a drilling fluid flowing downward within a drill string includes starting at an initial first position wherein a pilot (that can seat within a pilot seat which resides at the bottom of the middle inner flow channel) within a lower inner flow channel is not initially engaged with the pilot seat. The pilot is held in this position with the magnetic coupling. The next step involves rotating the motor causing the magnetic fields of the outer and inner magnets to move the pilot actuator assembly thereby moving the pilot into an engaged position with the pilot seat. This motion seals a lower inner flow channel from the middle inner flow channel and forces the inner fluid into a pair of upper connecting flow channels, expanding the sliding pressure chamber, causing a flow throttling device to move up toward a middle annular flow channel and stopping before the orifice seat, thereby causing a flow restriction. The flow restriction causes a pressure pulse or pressure increase transmitted uphole. At the same time, fluid remains in the exterior of the lower connecting flow channels, thus reducing the pressure drop across the, pilot seat. This allows for minimal force requirements for holding the pilot in the closed position. In the final position, the pilot moves back to the original or first position away from the pilot orifice while allowing fluid to flow through the second set of lower connecting flow channels within the lower inner flow channel. This results in evacuating the sliding pressure chamber as fluid flows out of the chamber and back down the upper flow connecting channels into the middle inner flow channel and eventually into the lower inner flow channel. As this occurs, the flow throttling device moves in a downward direction to open along the same direction as the flowing drilling fluid until motionless. This decreases the FTD created pressure restriction of the main drilling fluid flow past the flow throttling device orifice completing the pule.

An alternative embodiment includes the motor connected to a drive shaft through a mechanical device such as a worm gear, barrel cam face cam or other mechanical means for converting the rotational motion of the motor into linear motion to propel the pilot actuator assembly.

Opening Operation

When the pilot valve moves away (downward in the vertical direction) into the pilot orifice allowing the fluid to flow through the pilot exit and pass from the pilot flow exit channel causing relief of the higher pressure in the main valve pressure chamber. This allows for the pressure to be reduced and the fluid to escape the chamber. The fluid is then allowed to flow into the main fluid flow and flow through the main orifice pushing open (downward) or opening the main valve, thus allowing the main fluid to by pass the main valve and to flow unencumbered through the remainder of the tool.

When the main flow and pilot flow enters the main flow entrance and flows through into the flow cone area where the velocity of the fluid flow increases such that the fluid reaches the main orifice and the fluid flow velocity is increased (reducing the pressure and increasing the velocity of the fluid). The pressure of the fluid is decreased relative to the entrance flows (main area vs. the orifice area). When the pilot valve is in the opened position, the main valve is also in the open position and allows the fluid to pass through the main orifice and around the main valve and through the openings in the main valve support block allowing for the fluid to flow through the opening of the pilot and through the pilot valve support block. Subsequently the fluid flows into the main exit flow channel.

With reference now to FIG. 1, the device illustrated produces pressure pulses in drilling fluid flowing through a tubular drill collar and upper annular drill collar flow channel. The flow cone is secured to the inner diameter of the drill collar. The centralizer secures the lower portion of the pulse generating device and is comprised of a non-magnetic, rigid, wear resistant material with outer flow channels.

These conditions provide generation of pulses as the flow throttling device reaches both the closed and opened positions. The present invention allows for several sized FTD's to be placed in a drilling collar, thereby allowing for different flow restrictions and/or frequencies which will cause an exponential increase in the data rate that can be transmitted up hole.

Positioning of the main valve actuator assembly within the drill collar and utilizing the flow cone significantly decreases the turbulence of the fluid and provides essentially all laminar fluid flow. The linear motion of the flow throttling device axially is both up and down (along a vertical axial and radial direction without the use of a guide pole).

Conventional pulsers require adjustments to provide a consistent pulse at different pressures and flow rates. The signal provided in conventional technology is by a pulse that can be received up hole by use of a pressure transducer that is able to differentiate pressure pulses (generated downhole). These uphole pulses are then converted into useful signals providing information for the oilfield operators, such as gamma ray counts per second, azimuth, etc. Another advantage of the present invention is the ability to create a clean [essentially free of noise] pulse signal that is essentially independent of the fluid flow rate or pressure within the drill collar. The present invention thereby allows for pulses of varying amplitudes (in pressure) and frequencies to significantly increase the bit rate.

An additional embodiment of the present invention includes a system comprising a controllable pulser that operates sequentially within a downhole assembly such as a drill pipe, that enhances operational efficiency in the removal of hydrocarbon deposits, where the system comprises; a fluid, fluid flow, and a fluid drilling pump which when combined creates fluid flow into a bore pipe annulus such that a base line bore pipe pressure is created and such that fluid flow and bore pipe pressure is contained entirely within a drill string and wherein bore pipe pressure increases and is measured with one or more pressure sensors for sensing bore pipe pressure such that pressure sensor(s) send information to a digital signal processor (DSP) that receives information in the form of digital data from said pressure sensor(s), and wherein pulser utilize computerized instructional software and hardware components included in the digital signal processor (DSP) so that controllable sequential operation of the pulser is obtained utilizing one or more pressure sensors located within a bore pipe annulus located within an outer annular portion of the drill pipe.

The pre-programmed logic is embedded within the software components of the DSP such that the input data supplied to the DSP by one or more pressure sensors correctly determines pulser operation settings allowing for the sending of data that is subsequently received and interpreted by the DSP for controlling a pulser motor controller, wherein the motor controller controls adjustment of a stepper motor's current draw, response time, acceleration, duration, and revolutions corresponding with pre-programmed pulser settings provided by the software components of the DSP and wherein pulses are developed with a pilot actuator assembly that identically match the pulses of the pulser motor controller and operates the opening and closing of a main valve in a sequence dictated by the DSP, thereby creating pressure variations of the fluid pressure resulting from fluid flowing within the drill string and within the bore pipe.

The main valve opens and closes, thereby creating pressure variations of the fluid pressure in the annulus of the drill string in addition to the base line bore pipe pressure due to fluid flow movement restricted by the main valve, wherein the fluid pressure is also affected downstream of the pulser assembly as the fluid flows through a drill bit and jets within said bore hole pipe annulus.

While the present invention has been described herein with reference to a specific exemplary embodiment thereof, it will be evident that various modifications and changes may be made thereto without departing from the broader spirit and scope of the invention as set forth in the appended claims. The specification and drawings included herein are, accordingly to be regarded in an illustrative rather than in a restrictive sense.

What is claimed is:

1. A system comprising:

a controllable pulser utilizing a pilot actuator assembly that operates sequentially and bi-directionally within a downhole assembly within a drill string of a drill pipe, that enhances operational efficiency in the removal of hydrocarbon deposits, said system comprising; a drilling fluid, fluid flow, and a fluid drilling pump which when combined creates fluid flow into a bore pipe annulus within said downhole assembly such that a base line bore pipe pressure is created wherein said bore pipe pressure is sensed via a sensor sensing a pressure increase when said pump is operating such that said sensor sends information to a Digital Signal Processor (DSP) that interprets said information and wherein said DSP also receives information from an annulus pressure sensor that senses drilling fluid (mud) pressure as it returns to said pump in an annular outside portion of said drill pipe such said DSP recognizes pressure variation input obtained from said annulus pressure sensor and said bore pipe pressure sensor and detects pressure variation exhibited between pulsing pressures and a pump base line pressure thereby providing signals that are sent as data information to said DSP such that said DSP determines required action to properly adjust pulser operation settings for said pilot actuator assembly that includes channels designed so that only laminar flow and a water hammer effect occurs due to both said design and a decreased amount of time associated with the close of a main valve within said pilot actuator assembly, and subsequently sends information to a pulser motor controller that adjusts a stepper motor current draw, response time, acceleration, duration, and number of revolutions corresponding to any pre-programmed pulser settings wherein pulses within said pilot actuator assembly identically match the pulses of said pulser motor controller, as provided for by said DSP.

2. The system of claim 1, wherein pre-programmed logic is embedded within software components of said DSP such that the input data is supplied to said DSP by one or more pressure sensors, wherein said DSP subsequently correctly determines pulser operation in terms of, number of clean noise free pulses, amplitude of pulses, duration for pulses, and timing of pulses as settings all allowing for the sending of data that is subsequently received and interpreted by said DSP for controlling bit rate and said pulser motor controller, using a stepper motor driven by said pulser motor controller that operates said pilot actuator assembly, said pilot actuator assembly responding directly to said pulser motor controller by opening and closing said main valve of said controllable pulser in a sequence dictated by said DSP.

3. The system of claim 1, wherein opening and closing said main valve creates pressure variations of said fluid pressure in said drill string in addition to a bore pressure, wherein said bore pressure is created by a mud pump and wherein opening and closing said main valve also creates pressure variations or fluctuations of a fluid pressure in an annulus of said drill string in addition to a base line annulus pressure due to fluid movement restricted by said main valve which directly affects fluid pressure downstream of said controllable pulser assembly extending through a drill bit as fluid pressure controls jets that inject fluid into said bore hole pipe annulus.

4. The system of claim 1, wherein said annulus pressure sensor and a bore pipe pressure sensor detect pressure variations due to pulsing in comparison with a pump base line pressure wherein said pressure variations provide information signals to said DSP to ensure required actions for adjustment of continued pulser operation that also avoids excessive water hammer with pulses of varying amplitudes during opening and closing of said main valve.

* * * * *